US009862584B2

(12) United States Patent
Clüsserath

(10) Patent No.: US 9,862,584 B2
(45) Date of Patent: Jan. 9, 2018

(54) METHOD AND SYSTEM FOR FLUSHING CONTAINERS

(71) Applicant: KHS GmbH, Dortmund (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 37 days.

(21) Appl. No.: 14/911,128

(22) PCT Filed: Jul. 22, 2014

(86) PCT No.: PCT/EP2014/065717
§ 371 (c)(1),
(2) Date: Feb. 9, 2016

(87) PCT Pub. No.: WO2015/018633
PCT Pub. Date: Feb. 12, 2015

(65) Prior Publication Data

US 2016/0194188 A1 Jul. 7, 2016

(30) Foreign Application Priority Data

Aug. 9, 2013 (DE) ..... 10 2013 108 638

(51) Int. Cl.
*B67C 3/10* (2006.01)
*B08B 9/28* (2006.01)
*B08B 9/20* (2006.01)

(52) U.S. Cl.
CPC ..... *B67C 3/10* (2013.01); *B08B 9/20* (2013.01); *B08B 9/283* (2013.01)

(58) Field of Classification Search
CPC ..... B08B 9/20; B08B 9/283; B67C 3/10
USPC ..... 141/54–57, 92
See application file for complete search history.

(56) References Cited

U.S. PATENT DOCUMENTS

| | | | | |
|---|---|---|---|---|
| 5,501,253 | A * | 3/1996 | Weiss | B67C 3/2614 141/198 |
| 5,634,500 | A * | 6/1997 | Clusserath | B67C 3/10 141/44 |
| 6,189,578 | B1 * | 2/2001 | Clusserath | B67C 3/10 141/293 |
| 6,213,169 | B1 * | 4/2001 | Clusserath | B67C 3/10 141/40 |
| 7,353,848 | B2 * | 4/2008 | Krulitsch | B67C 3/06 141/146 |
| 7,469,726 | B2 * | 12/2008 | Clusserath | B67C 3/04 141/144 |
| 7,647,950 | B2 * | 1/2010 | Clusserath | B67C 3/2628 141/44 |
| 7,721,773 | B2 * | 5/2010 | Stadlmayr | A23L 2/54 141/302 |
| 8,434,530 | B2 * | 5/2013 | Conforti | B67C 3/10 141/105 |
| 2002/0139434 | A1 | 10/2002 | Meheen | |
| 2016/0194188 | A1 * | 7/2016 | Clusserath | B08B 9/283 141/7 |

FOREIGN PATENT DOCUMENTS

| | | |
|---|---|---|
| DE | 199 39 521 | 9/2000 |
| DE | 100 08 426 | 8/2001 |
| DE | 10 2007 015 752 | 10/2008 |
| DE | 10 2013 102611 | 9/2014 |
| EP | 0 308 721 | 3/1989 |

* cited by examiner

*Primary Examiner* — Timothy L Maust
(74) *Attorney, Agent, or Firm* — Occhiuti & Rohlicek LLP

(57) ABSTRACT

A method for processing containers includes introducing flushing gas into a container's interior while the interior remains connected to a vacuum source, and adjusting flow of the flushing gas and an underpressure of the vacuum source such that, while flushing gas flows through the interior, a flushing pressure in the interior lies between 0.46 and 0.9 bar.

14 Claims, 16 Drawing Sheets

METHOD AND SYSTEM FOR FLUSHING CONTAINERS

RELATED APPLICATIONS

This is the U.S. national stage, under 35 USC 371, of PCT application PCT/EP2014/065717, filed on Jul. 22, 2014, which claims the benefit of the Aug. 9, 2013 priority date of DE 102013108638.1, the contents of which are herein incorporated by reference.

FIELD OF INVENTION

The invention relates to container processing, and in particular, to a method for flushing containers with a flushing gas.

BACKGROUND

Methods for the filling, and also of pressure filling of containers are known. It is also known to evacuate the interior of a container before filling, and to then flush it with a flushing gas. A suitable flushing gas is an inert gas, carbon dioxide, or sterile air. This flushing step removes, from the interior of the container, any ambient air that is present, or other gaseous and/or vaporous medium that is present.

SUMMARY

An object of the invention is to provide a particularly effective way to flush a container's interior without using very much flushing gas.

In one aspect, the invention features a flushing method that includes connecting the container to a vacuum source to evacuate its interior and blowing in flushing gas while the container's interior remains connected to the vacuum source. Thus, introduction of the flushing gas takes place into a vacuum or at least a substantial underpressure in the container interior.

In some practices, evacuation takes place to an extent such that a pressure in the container is in the range of 0.05 to 0.4 bar. In some practices, the pressure is in the range of 0.05 to 0.25 bar, i.e. an underpressure of some 0.6 bar to 0.95 bar. In other embodiments, the pressure is in the range of around 0.75 to 0.95 bar in relation to ambient pressure.

In other practices, flushing gas is blown in at such a pressure, and/or with such a volume flow so that the pressure in the container's interior is in the range between 0.46 bar and 0.9 bar. Further practices include those in which the range is between pressures of 0.5 bar and 0.55 bar, 0.6 bar and 0.65 bar, 0.7 bar and 0.75 bar to 0.8 bar.

Preferably, as a result of the introduction or blowing in of the flushing gas, only a slight pressure rise takes place in the container interior. In some practices, the pressure rise is between 0.1 bar and 0.2 bar. As a result, it is possible to avoid or minimize loading the container with high-pressure fluctuations.

An advantage of the method according to the invention is the effective flushing of the container interior with a substantial reduction in the consumption of flushing gas. Specifically, the method described herein uses up to five times less flushing gas than corresponding flushing methods that are carried out under atmospheric or ambient pressure, or at a pressure above atmospheric or ambient pressure.

The lower consumption of flushing gas or inert gas represents substantial cost savings. It is also possible, with the flushing method according to the invention for oxygen consumption to be substantially reduced during the subsequent filling.

In one aspect, the invention features a method for processing containers using a container-processing machine having a plurality of treatment heads. Such a method includes sealing the container against a treatment head, connecting the container's interior to a vacuum source and evacuating it, while the container is still connected to the vacuum source, introducing flushing gas into the interior, and displacing gas out of the interior. During all of this, the flow-rate of the flushing gas and an underpressure of the vacuum source are controlled such that a flushing pressure in the interior lies between 0.46 and 0.9 bar while flushing gas flows through the container's interior.

In some practices, introducing flushing gas only occurs after the container's interior has been evacuated to a pressure of between 0.05 bar and 0.4 bar. In these embodiments, the introduction of flushing gas causes the container's interior pressure to rise up to a range between 0.46 and 0.9 bar.

In yet other practices, the treatment head has first and second gas channels formed therein. In these practices, connecting the interior to a vacuum source includes connecting the interior to the first gas channel, and introducing flushing gas into the interior includes introducing the flushing gas through the second gas channel.

Also among the practices of the invention are those that include causing the flushing gas to emerge at a point along a central axis of the container.

In other practices, introducing flushing gas into the interior includes extending a tube into the interior and causing the flushing gas to flow into the interior through the tube.

Yet other practices include causing the flushing gas to flow from a gas chamber that contains the flushing gas under pressure, and, using a choke to choke its flow.

Still other practices include using a pressure sensor to provide information indicative of the flushing pressure, and controlling the flushing pressure based at least in part on the information. Among these practices are those in which the pressure sensor monitors pressure only for one treatment head independently of other treatment heads, and also those in which the pressure sensor monitors pressures at each treatment position in the plurality of treatment positions.

Yet other practices of the invention include filling the interior with liquid filling-product after flushing it. Among these are practices that include providing the flushing gas from a flushing-gas source having flushing gas pressure that is independent of a gas pressure maintained in a gas space of a filling-product container that supplies the liquid filling-product.

Yet other practices include causing pretensioning-gas to flow into the container's interior at a higher rate than the flushing gas.

Yet other practices include using two different gas valves to control flow of pretensioning gas and flushing gas.

In other aspect, the invention features an apparatus for implementing any combination of the foregoing methods.

As used herein, the term "containers" refers to containers made of glass, including glass bottles, or similar stable containers consisting of metal and/or plastic, such as kegs, party barrels, reusable plastic bottles, etc. An important factor is that containers used with the method according to the invention have adequate stability such that, during evacuation, they are not deformed to an undesirable extent or even destroyed.

As used herein, a container is deemed to be "in a sealed position with the treatment head or filling element" when it is pressed tightly with its container mouth in contact with the treatment head or the filling element, or a seal located there.

As used herein, expressions such as "essentially" or "some" refer to deviations from an exact value by ±10%, preferably by ±5%, and/or deviations in the form of changes that are not of significance to the function.

These and other features and advantages of the invention will be apparent from the following detailed description and the accompanying figures, in which:

DETAILED DESCRIPTION

Figure 1:
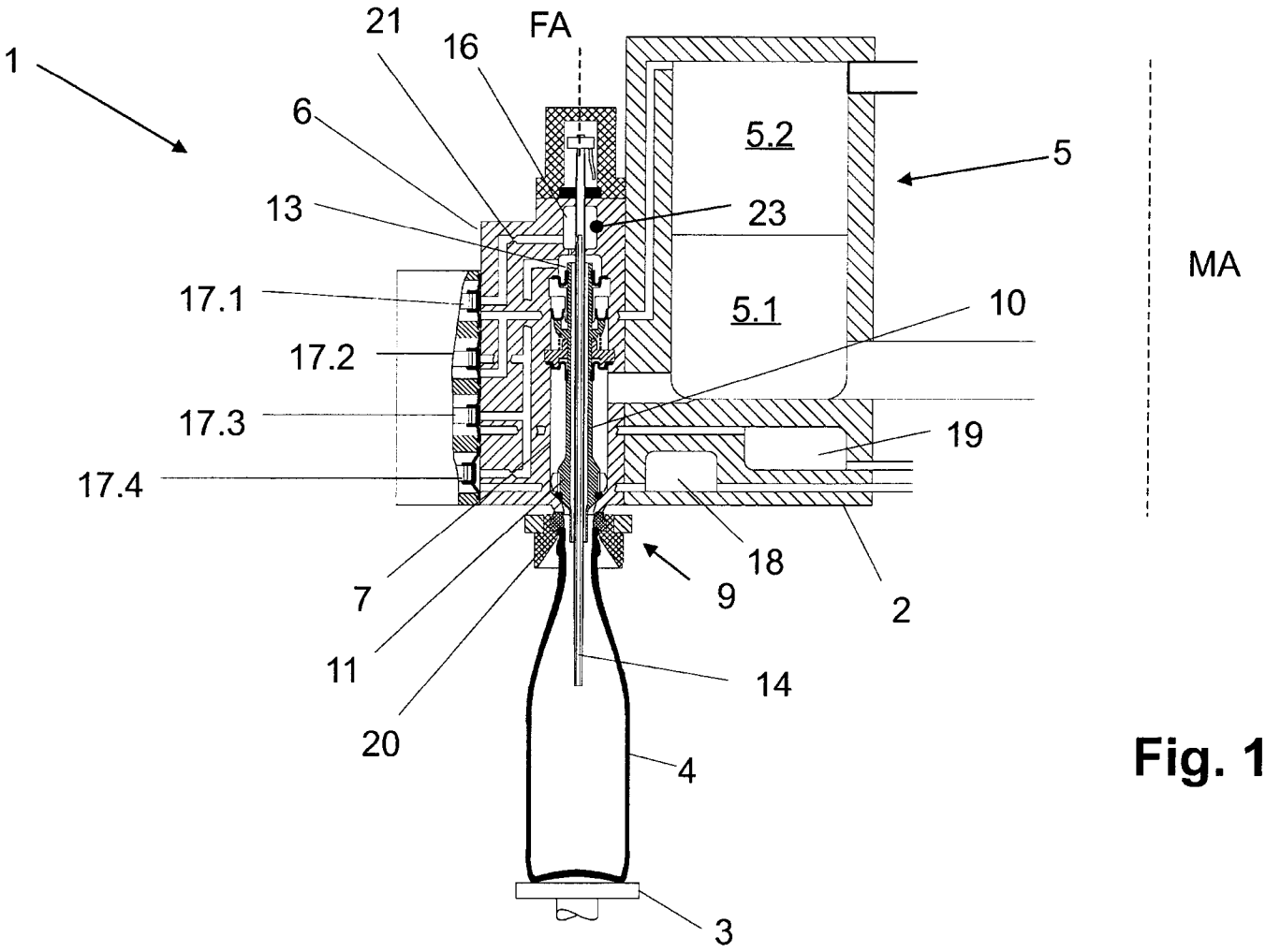
FIG. 1 shows a portion of a rotary filling machine having a filling element with a bottle sealed against it.

FIG. 1 shows a filling element 1 that is one of a plurality of filling elements of the same type disposed on the circumference of a rotor 2 that is driven to rotate about a vertical machine-axis MA. Each filling element 1, together with a container carrier 3, forms a filling point for filling a container 4. These containers 4 are made of glass, metal, or plastic with adequate strength. Examples of containers 4 include bottles.

A ring vessel 5 on the rotor provides liquid filling-product to all the filling elements 1. During the filling procedure, the liquid filling-product partially fills the ring vessel 5. This liquid filling-product divides the ring vessel 5 into a lower chamber 5.1 and an upper chamber 5.2. An inert gas at filling pressure fills the upper chamber 5.2. Examples of inert gas include carbon dioxide gas and nitrogen gas.

A housing 6 of the filling element 1 defines a liquid channel 7 that connects to the ring vessel's lower chamber 5.1. At the underside of the filling element 1, the liquid channel 7 forms a ring-shaped discharge opening 8, best seen in FIG. 2, that concentrically surrounds a vertical filling-element axis FA.

Figure 2:
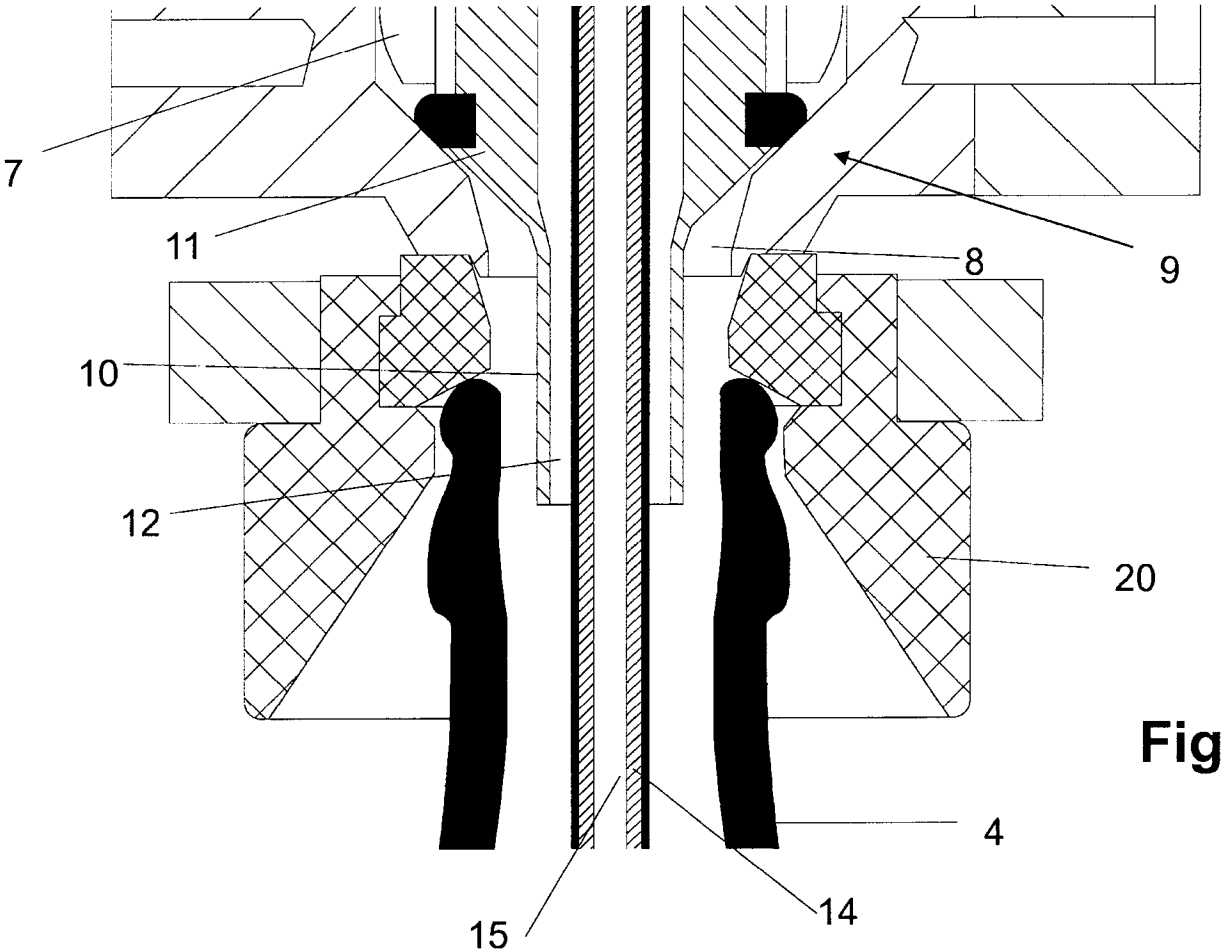
FIG. 2 is a close-up view of the region around the centering element in FIG. 1.

Within the liquid channel, a tubular valve-tappet 10 forms a liquid-valve body 11 of a liquid-valve 9. An actuator moves the liquid-valve body 11 axially in a controlled manner to open and close the liquid-valve 9. A first gas-channel 12 extends through the tubular valve-tappet 10. Referring to FIG. 2, a lower end of the tubular valve-tappet 10 projects downward beyond the discharge opening 8. An upper end of the tubular valve-tappet 10 opens into a first gas chamber 13 formed in the housing 6. The first gas-channel 12 thus extends through the tubular valve-tappet 10 between the container's interior and the first gas chamber 13.

During filling, a return gas-tube 14 passes through the tubular valve-tappet 10 as shown in FIG. 2 and forms a second gas-channel 15 that passes through the first gas-channel 12. The return gas-tube 14 projects beyond the lower end of the tubular valve-tappet 10 into the container's interior.

As liquid filling-product fills the container 4, the level eventually reaches the bottom of the return gas-tube 14. When this happens, no further return gas can escape the container. This stops the flow of incoming liquid filling-product. Thus, the extent to which the return gas-tube 14 projects into the container's interior determines a filling height to which the container 4 is to be filled with liquid product.

An upper end of the return gas-tube 14 opens into a second gas-chamber 16 formed in the housing 6. This second gas-chamber 16 lies on a gas path that differs from that along which the first gas-chamber 13 lies. As a result, the second gas-channel 15 extends from the container's interior to the second gas-chamber 16.

Figure 3:
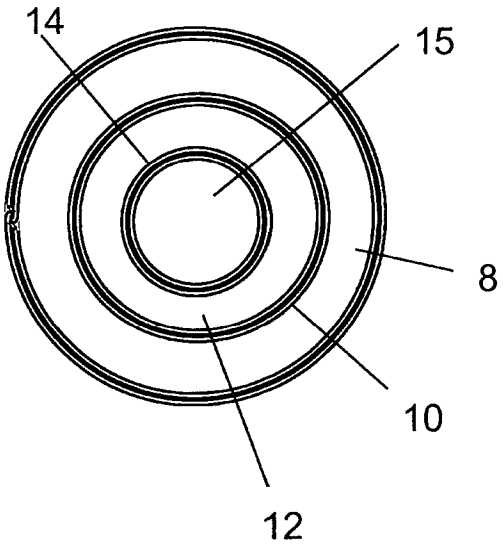
FIG. 3 shows a cross-section through the discharge opening shown in FIG. 2.

FIG. 3 shows a cross-section through the discharge opening 8 in which it is possible to see the tubular valve-tappet 10 and, inside it, the return gas-tube 14, both of which are concentric with the filling-element axis FA. As is apparent, the first gas-channel 12 has an annular cross-section that extends between the inner wall of the tubular valve-tappet 10 and the outer wall of the return gas-tube 14. The second gas-channel 15, which is inside the return gas-tube 14, has a circular cross-section.

A first control-valve 17.1, a second control-valve 17.2, a third control-valve 17.3, and a fourth control-valve 17.4 cooperate to selectively connect the first and second gas-channels 12, 15 in a controlled manner to the ring vessel's upper chamber 5.2 and to first and second ring-channels 18, 19.

The first and second ring-channels 18, 19 are common to all the filling elements 1 in the filling machine. The first ring-channel 18 relieves pressure in filled containers 2 once filling is complete. The second ring-channel 19 carries a vacuum or underpressure during filling. Typical underpressure values are 0.05 bar to 0.25 bar.

Referring to FIG. 2, a centering element 20 contacts an underside of the housing 6 and seals against a container 4 such that the discharge opening 8 and the lower opening of the first gas-channel 12 open into an upper region of the container's interior.

A suitable flushing method for flushing a container without using too much flushing gas includes at least an evacuation step and a flushing step.

In the evacuation step, the liquid-valve 9, the first control-valve 17.1, the second control-valve 17.2, and the fourth control-valve 17.4 all close. The third control-valve 17.3 is open to allow gas in the container's interior to be evacuated into the first gas chamber 13 via the first gas-channel 12. A suitable vacuum for carrying out such evacuation is a 95% vacuum or a pressure in the range from 0.0-0.4 bar, and preferably to a pressure in the range from 0.05-0.25 bar.

In the flushing step, the third control-valve 17.3 remains open and the first control-valve 17.1 opens to allow inert gas to be blown in from the upper chamber 5.2 via the still open first control-valve 17.1 and via a first choke 21 into the second gas chamber 16, and out of the second gas chamber 16 via the second gas-channel 15 in the direction of the filling-element axis FA downwards. This inert gas serves as a flushing gas for the interior of the container 4. Since the return gas-tube 14 extends deep into the container's interior, the flushing gas emerges from the return gas-tube 14 near the base of the container 4. Any air forced out by the flushing gas, as well as the flushing gas itself, exits via the first gas-channel 12, the first gas chamber 13, and the opened third control-valve 17.3 and into the second ring-channel 19, which conducts it away.

The first choke 21 suppresses the flow of flushing gas to an extent such that the underpressure that was set while the container was flushing in the first method step rises only slightly, for example by only 0.1 bar to 0.4 bar, and preferably by only 0.1 bar to 0.2 bar. As a result, in the second method step, the internal pressure in the container is still substantially below the flushing pressure, for example by 0.46 bar to 0.8 bar.

Some practices include intensifying the flushing through time-controlled introduction of the flushing gas in the flushing step without interruption. Some practices introduce flushing gas at intervals. In these practices, flushing gas does not arrive all at once. Instead, it is metered in a plurality of steps.

In an optional feature, regardless of how the flushing gas is introduced, the connection between the container's interior and the second ring-channel 19 remains. As a result the vacuum present in the second ring-channel 19 remains in communication with the container's interior. This tends to reduce the cost of flushing.

In some embodiments, the flushing step repeats multiple times, with each repetition being separated from adjacent repetitions by a repetition of the evacuation step.

Figure 4:
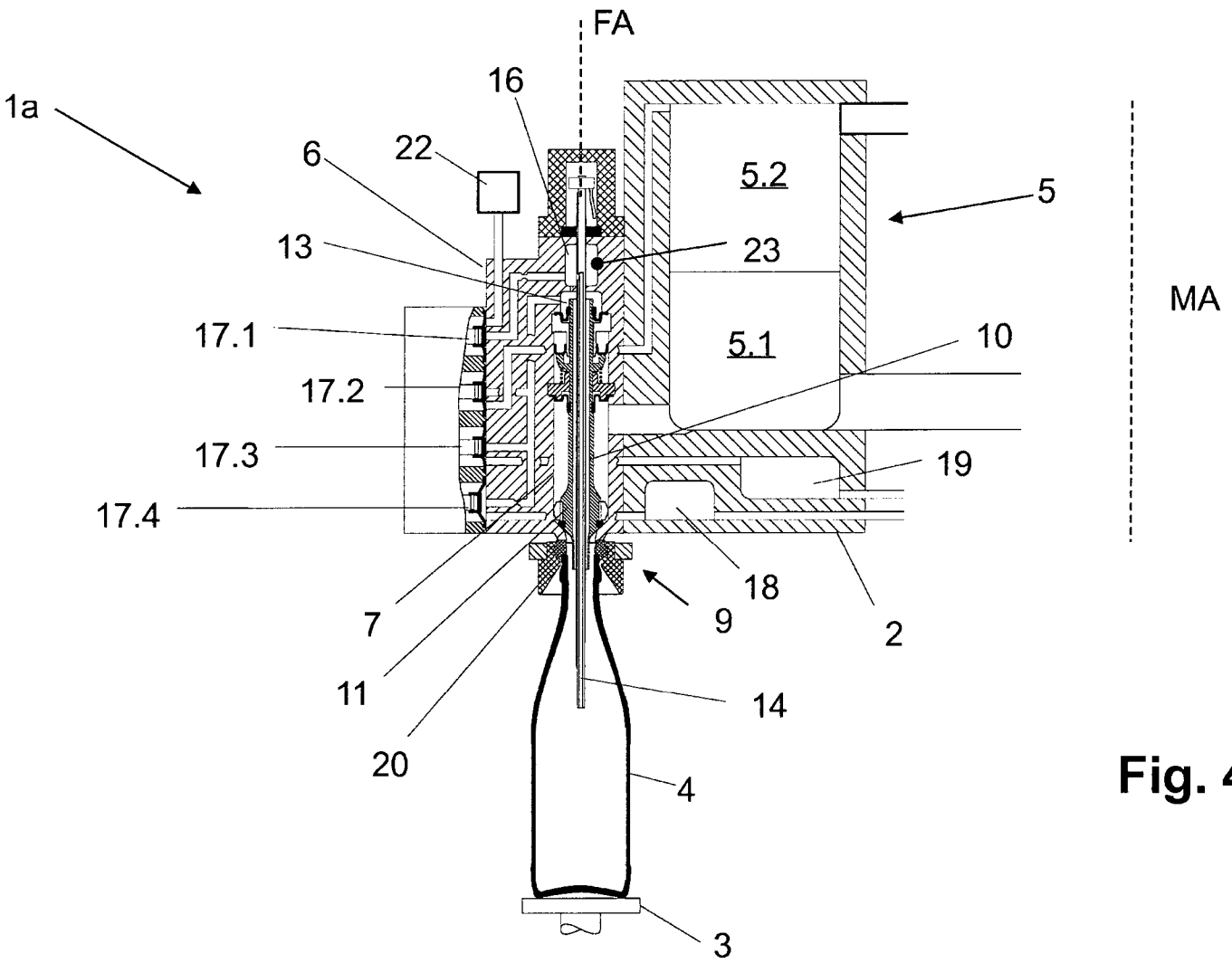
FIG. 4 shows an embodiment similar to that in FIG. 1 but with a separate source of flushing gas.

FIG. 4 shows an alternative filling element 1*a* in which the first control-valve 17.1 does not connect on its inlet side to the upper chamber 5.2. Instead, it connects to a separate flushing-gas source 22 that supplies flushing gas at a certain overpressure. Because the flushing-gas source 22 is separate from the upper chamber 5.2, the overpressure in the flushing-gas source 22 can be chosen independently of the filling pressure. This provides flexibility for achieving a low flushing pressure.

Figure 5:
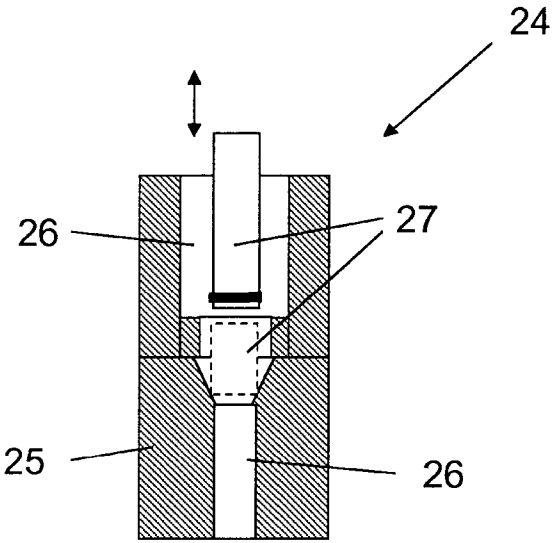
FIG. 5 shows a controllable gas valve for use with any one of the filling elements shown in the preceding figures.

A choke 24, as shown in FIG. 5, regulates flushing pressure in the container's interior to a desired level. The choke 24 does so by choking the flushing-gas' path. The choke 24 transitions between a first state and a second state. In the first state, the choke 24 does not choke the path. In the second state, it does. Some chokes 24 also have a third state for completely blocking the path.

A pressure sensor 23 arranged in the filling element 1 provides a basis for controlling the choke 24. A suitable location for the pressure sensor 23 is in the second gas chamber 16.

The choke 24 includes a choke body 25 that defines a flow channel 26, and an axially-movable valve body 27. The choke body 25 widens in order to narrow the flow channel 26, thus forming a choke. Depending on its position, the axially-movable valve body 27 opens the flow channel 26, narrows it, or closes it entirely.

The embodiments shown in FIGS. 6 to 16 include a ring vessel 101 of a single-chamber filling machine that contains liquid filling-product for filling containers 102. In the illustrated embodiment, the containers 102 are bottles.

The ring vessel 101 is part of a rotor that rotates about a vertical machine-axis. During filling, liquid filling-product partially fills the ring vessel 101 up to a controlled level. The liquid filling-product defines a ring-vessel liquid-chamber 101.1 and a ring-vessel gas-chamber 101.2 above the ring-vessel liquid-chamber 101.1. A gas fills the upper gas-chamber 101.2. Examples of gas include inert gas, carbon dioxide, nitrogen, and sterile air.

On the underside of the ring vessel 101 are filling positions 103 that are evenly distributed around the periphery of the rotor. Each filling position 103 is separated from its neighbors by an offset angle.

A typical filling position 103 has a container carrier 105, on which a container stands on its base, and a filling element 104. During filling, the container carrier 105 raises the container 102, thereby pressing the container's opening tightly against the filling element 104. A centering element 106 provides a ring seal to seal the container 102 against the filling element 104.

In the illustrated embodiment, the filling element 104 includes a flat plate-type filling element housing 107 in which is formed a liquid channel 108. The liquid channel 108 extends between the ring vessel 101 and the underside of the filling element housing 107. An opening 109 in the base of the ring vessel 101 connects the liquid channel 108 to the ring-vessel liquid-chamber 101.1. At the other end of the liquid channel 108, the filling element housing 107 forms a filling-product discharge opening 110 surrounded by the ring seal. It is through this filling-product discharge opening 110 that liquid filling-product flows into a container 102.

A liquid-valve 111 inside the liquid channel 108 controls flow of liquid filling-product into a container 103. The liquid-valve 111 includes a liquid-valve body 112 on a liquid-valve tappet-tube 113 that extends in a direction coaxial with a filling-element axis FA. Optionally, the liquid-valve body 112 includes a gas block 112.1. Movement of the liquid-valve body 112 along the filling-element axis FA opens and closes the liquid-valve 111. When the liquid-valve body 112 rests against a valve seat formed in the liquid channel 108, the liquid-valve 111 closes.

A first gas-channel 114 formed in the liquid-valve tappet-tube 113 continues into a gas tube 115. When a container 102 is sealed against the filling element 104, the gas tube 115 extends through the container's opening and into its head space. At its lower end, the gas tube 115 forms the lower opening of the first gas-channel 114.

A gas-valve body 117 forms a first gas-valve 116 in the first gas-channel 114. The first gas-valve 116 takes the shape of a hollow needle that is coaxial with the filling-element axis FA and that is disposed in an upper portion of the first gas-channel 114. To open the first gas-valve 116, one raises this needle relative to the liquid-valve tappet-tube 113. Conversely, to close the first gas-valve 116, one lowers this needle relative to the liquid-valve tappet-tube 113. Lowering the needle causes a valve surface at the lower end of the gas-valve body 117 to contact a valve seat formed in the first gas-channel 114, and to thereby block the first gas-valve 116.

The gas-valve body 117 has an outer cross-section that is selected in such a way that the first gas-channel 114, which surrounds a gap that surrounds the gas-valve body 117, continues as far as the upper open end of the liquid-valve tappet-tube 113.

A second gas-channel 121, which is formed in the interior of the gas-valve body 117, runs coaxially with the first gas-channel 114, and preferably runs through the gas-valve body 117 over its entire length.

The gas-valve body 117 is a tubular valve body. When the first gas-valve 116 closes, a lower free end of the gas-valve body 117 opens into the first gas-channel 114 in a fluid-tight manner. A second gas-valve 123, best seen in FIG. 8, defines an orifice 124.

An actuator 118 controls the first and second gas-valves 116, 123. A suitable actuator 118 is a pneumatic actuator. Preferably, the actuator 118 is on an upper side of the ring vessel 101, and, in some embodiments, outside the ring vessel 101. An actuator tappet 119, arranged coaxially with the filling-element axis FA and an adapter 120 cooperate to couple the actuator 118 to an upper end of the gas-valve body 117.

Figure 8:
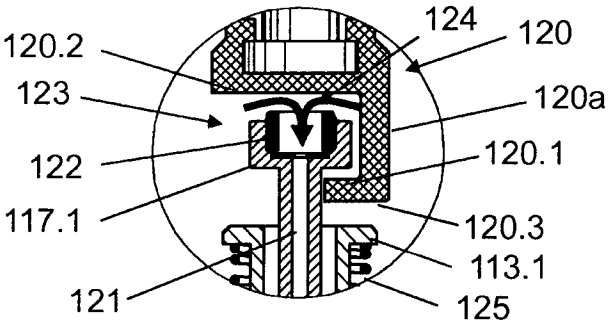
FIG. 8 shows a gas valve from the filling element shown in FIGS. 6 and 7.

Referring to FIG. 8, a control section 117.1 of the gas-valve body 117 extends radially outward on a free-end of the gas-valve body 117. This causes the gas-valve body 117 to have a stepped profile.

Electro-pneumatic control-valves enable the actuator 118 to cause a controlled two-step axial movement of the actuator tappet 119 and therefore of the adapter 120. To facilitate this two-step movement, the actuator 118 includes first and second pneumatic lifts. The first pneumatic lift is a lower piston-cylinder arrangement 118*a*. The second pneumatic lift is an upper piston-cylinder arrangement 118*b*.

The lower piston-cylinder arrangement 118*a* has a piston 118.1 that is coupled directly at the actuator tappet 119. In effect, the actuator tappet 119 itself forms the piston rod of this piston-cylinder arrangement 118*a*. A folding bellows seal seals an opening through which the actuator tappet 119 passes through the upper side of the ring vessel 101. This prevents contamination of the liquid filling-product.

Meanwhile, the upper piston-cylinder arrangement 118*b* has its own piston 118.2, which is mounted on a further piston rod that is coaxial with the filling-element axis FA.

The piston rod of the upper piston-cylinder arrangement 118*b* forms a contact element for the piston rod of the lower piston-cylinder arrangement 118*a*. As a result, when the upper piston-cylinder arrangement 118*b* is in its lower position, it limits the lift of the piston rod of the lower piston-cylinder arrangement 118*a* to a first lift-extent H1. On the other hand, when the upper piston-cylinder arrangement 118*b* is in its upper position, in which it is raised by a second lift-extent H2, the lower piston-cylinder arrangement 118*a* can be lifted by an extent that is equal to the sum of the first and second lift-extents H1, H2, namely (H1+H2).

Referring now to FIG. 8, the adapter 120 includes a sealing surface 120.2 that selectively engages the orifice 124 provided on the upper side of the gas-valve body. The sealing surface 120.2 and the orifice 124 thus form the second gas-valve 123.

A hook 120*a* extends distally from the sealing surface 120.2. The hook 120*a* has a proximal control surface 120.1 and a distal control surface 120.3 that extends parallel to the proximal control surface 120.1. The proximal and distal control surfaces 120.1, 120.3 are on opposite sides of the hook 120*a*. The hook's proximal control surface 120.1 selectively engages the gas-valve body's control-flange 117.1.

When the sealing surface 120.2 engages the orifice 124, a gap separates the hook's proximal control surface 120.1 from the gas-valve body's control-flange 117.1. This produces a certain amount of axial play. As a result, when the actuator tappet 119 rises, this axial play prevents the actuator tappet 119 from immediately raising the gas-valve body 117. As a result, the first gas-valve 116 remains closed. The axial distance between the hook's proximal control surface 120.1 and the adapter's sealing surface 120.2 along the vertical filling-element axis FA is preferably greater than or equal to the first lift-extent H1.

As the lower piston-cylinder arrangement 118*a* pushes the actuator tappet 119 into a lower position, the adapter's sealing surface 120.2 contacts the orifice 124. This closes the second gas-valve 123. At the same time, the actuator tappet 119 extends as far as possible into the container 102. With the gas-valve body 117 thus having been pushed completely into the first gas-channel 114, the first gas-valve 116 closes. This establishes a fluid-tight connection between the second gas-channel 121 and the first gas-channel 114.

With the piston rod of the upper piston-cylinder arrangement 118*b* in the lower position, the actuator 118 actuates the lower piston-cylinder arrangement 118. This raises the actuator tappet 119, and hence the adapter 120, by the first lift-extent H1. When this happens, the adapter's sealing surface 120.2 rises up from the seal at the orifice 124, thus opening the second gas-valve 123. This means that gas from the ring-vessel gas-chamber 101.2 can now pass through the orifice 124, flow through the second gas-channel 121, then on through the first gas-channel 114, and out the lower end of the gas tube 115 to reach the head space of the container 102 at the filling element 104.

Preferably, the cross-section of the second gas-channel 121 is smaller than that of the first gas-channel 114. This chokes the delivery of gas out of the ring-vessel's gas-chamber 101.2 into the container 102. In addition, a choke can be provided in the region of the orifice 124. This likewise chokes gas delivery out of the ring-vessel's gas-chamber 101.2 into the container 102.

With the upper piston-cylinder arrangement 118*b* in its upper position, the lower piston-cylinder arrangement 118*a* raises the actuator tappet 119 by an extent equal to the sum of the first and second lift extents H1, H2. This lifts the hook's proximal surface 120.1 so that it engages the gas-valve body's control-flange 117.1 from below, thus drawing it, and the gas-valve body 117, upwards and out of the first gas-channel 114. This opens the first gas-valve 116.

A spring 125 inside the ring vessel 101 extends from a distal surface of a tappet-flange 113.1 located at the upper end of the liquid-valve tappet-tube 113 and a tubular element 127 around the liquid-valve tappet-tube 113. The spring 125 assists in opening the liquid-valve 111 in a manner described below.

Figure 6:
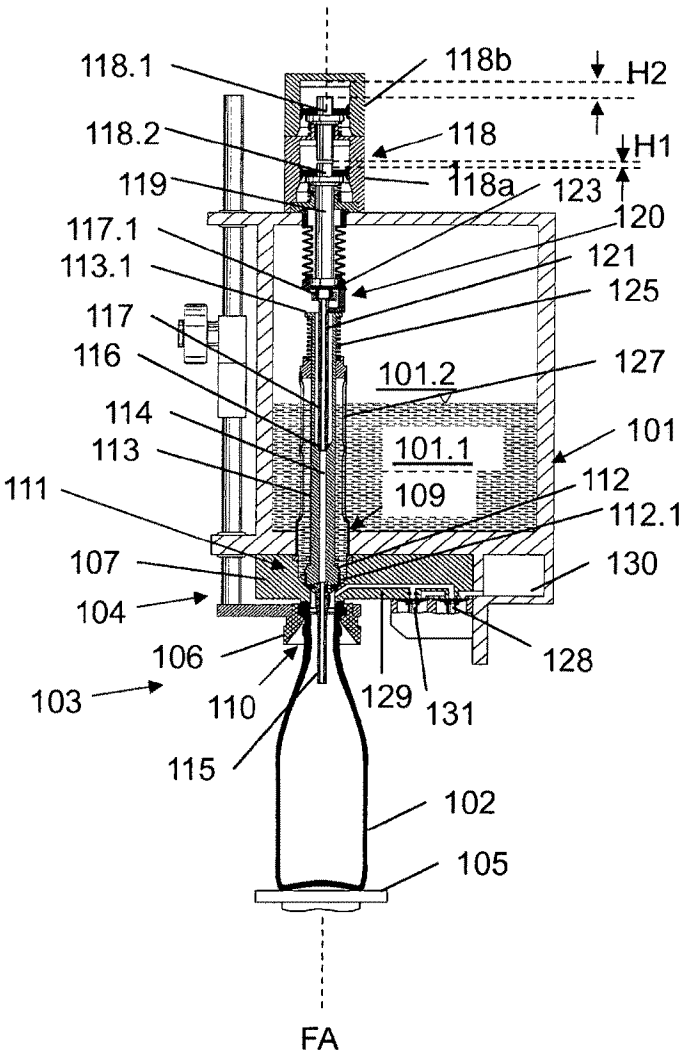
FIG. 6 shows a vertical section of a filling element that is at least partially accommodated in a ring vessel.

FIG. 6 shows the filling element 104 and the actuator 118 in a first operational state in which the liquid-valve 111, the first gas-valve 116, and the second gas-valve 123 are all closed. The container carrier 105 is pressing the container 102 from below onto the ring seal in the region of the centering element 106. As a result, the container 102 is sealed against the filling element 104.

Next, a vacuum control-valve 128 opens to establish a connection between a vacuum source 130 and the container's interior via a vacuum channel 129 provided in the filling element housing 107. The vacuum source 130 and the vacuum control-valve 128 are preferably actuated to cause a pressure of 0.05-0.4 bar in the interior of the container 102. Preferably, the container 102 is evacuated to a 95% vacuum.

Figure 7:
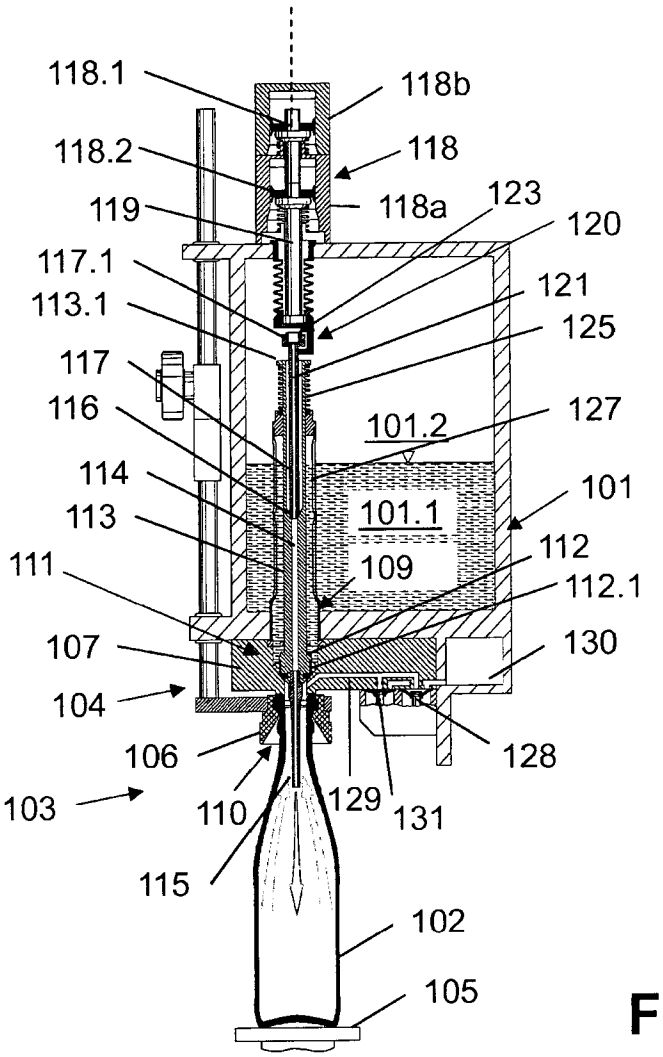
FIG. 7 shows a vertical section of the filling element of FIG. 6 during the flushing process.

Next, as shown in FIGS. 7 and 8, the second gas-valve 123 opens by having the actuator 118 raise the actuator tappet 119 by a first lift-extent H1 to raise the sealing surface 120.2 off of the orifice 124. This creates a continuous gas channel between the ring-vessel gas-chamber 101.2 and the container's interior. The continuous gas channel begins at the orifice 124, proceeds through the second gas-channel 121, and through the first gas-channel 114, the latter having been connected in a fluid-tight manner to the second gas-channel 121. It then continues through the gas tube 115. The gas in the ring-vessel's gas-chamber 101.2 thus flushes the container's interior. Meanwhile, the container's interior remains connected to the vacuum source 130 via the vacuum channel 129. The vacuum source 130 thus sucks out the air displaced by the incoming flushing gas. This results in a particular intensive and effective flushing of the interior of the container 102.

Because the gas tube 115 extends deeply into the container's interior, the flushing gas that emerges from the gas tube 115 reaches the base of the container 102. Additionally, because the flow of flushing gas has been choked, the underpressure that was set during the evacuation, before the flushing begins, rises only slightly during the flushing process. In preferred practices, the rise is between 0.05 bar and 0.2 bar. This means that the pressure in the container 102 after flushing is still slightly below the ambient pressure. In preferred practices, this pressure is between 0.46 bar and 0.8 bar.

Some embodiments intensify the flushing through time-controlled introduction of the flushing gas. Alternative embodiments introduce the flushing gas at intervals, in a plurality of part steps.

Figure 9:
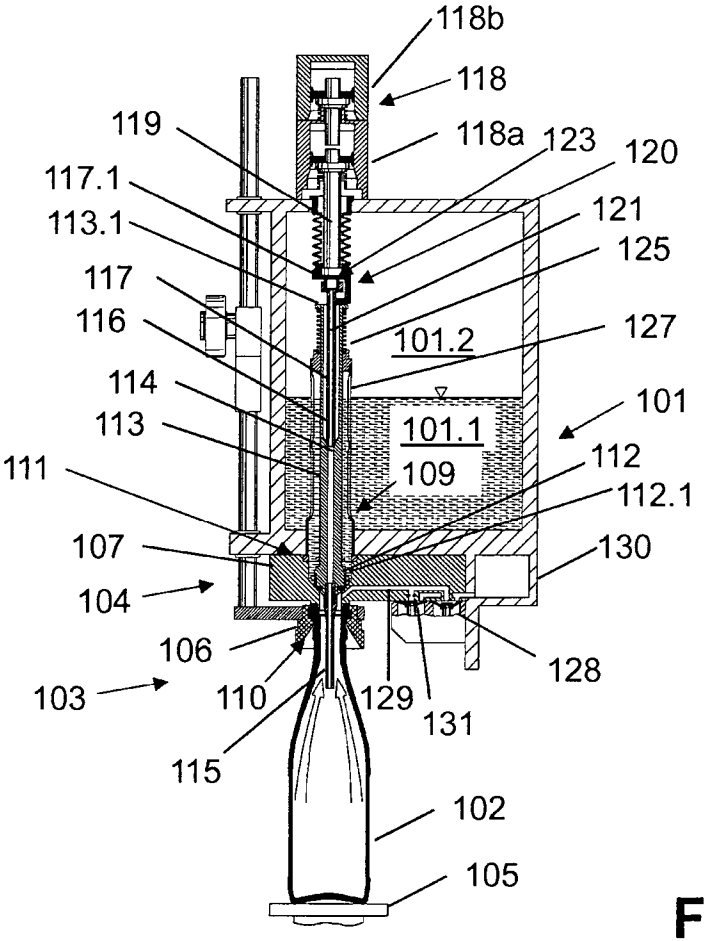
FIG. 9 shows a vertical section of the filling system of FIGS. 6 and 7 while evacuating the container with the help of a vacuum.

Referring now to FIG. 9, the actuator tappet 119 next moves into a lower position to close the second gas-valve 123. This ends the flushing process. In this state, the vacuum control-vale 128 remains open, thus enabling the vacuum channel 129 to continue connecting the container's interior to the vacuum source 130. As a result, the container 102 is evacuated to the original underpressure prior to the start of the flushing process. This increases the efficiency of the flushing process.

Figure 10:
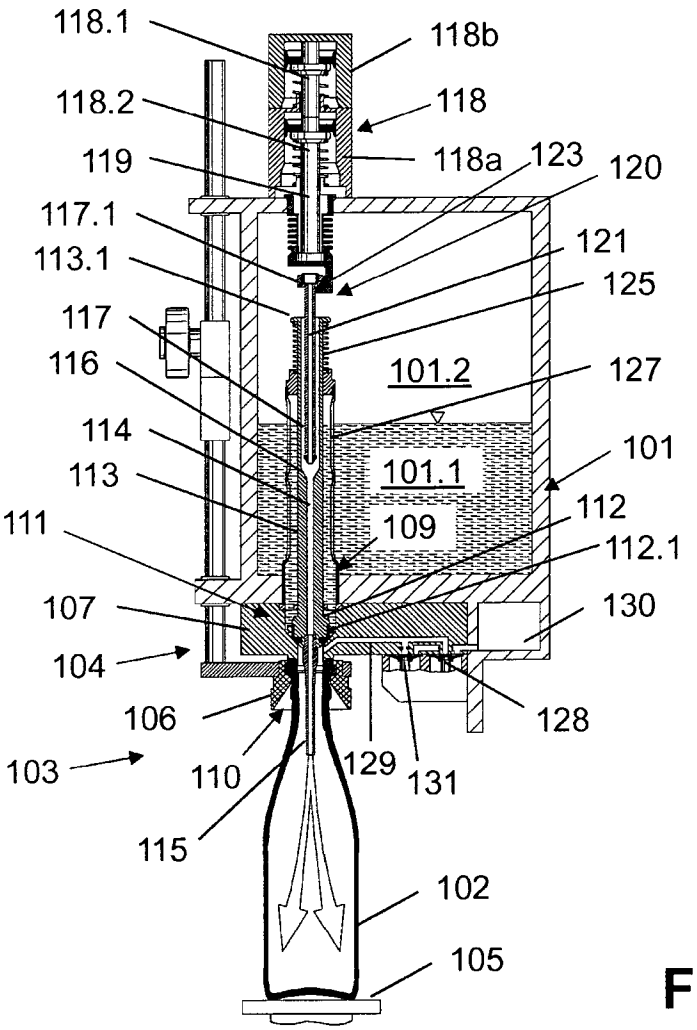
FIG. 10 shows a vertical section of the filling system of FIGS. 6 and 7 while pre-tensioning the container.
Figure 11:
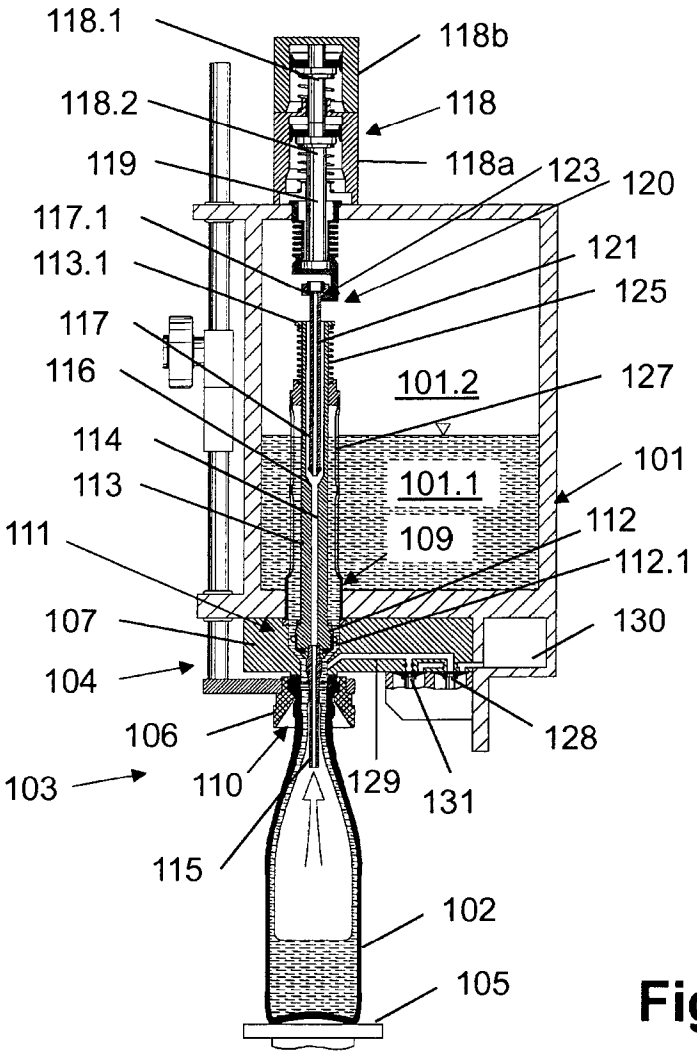
FIG. 11 shows a vertical section of the filling system of FIGS. 6 and 7 while filling the container.
Figure 12:
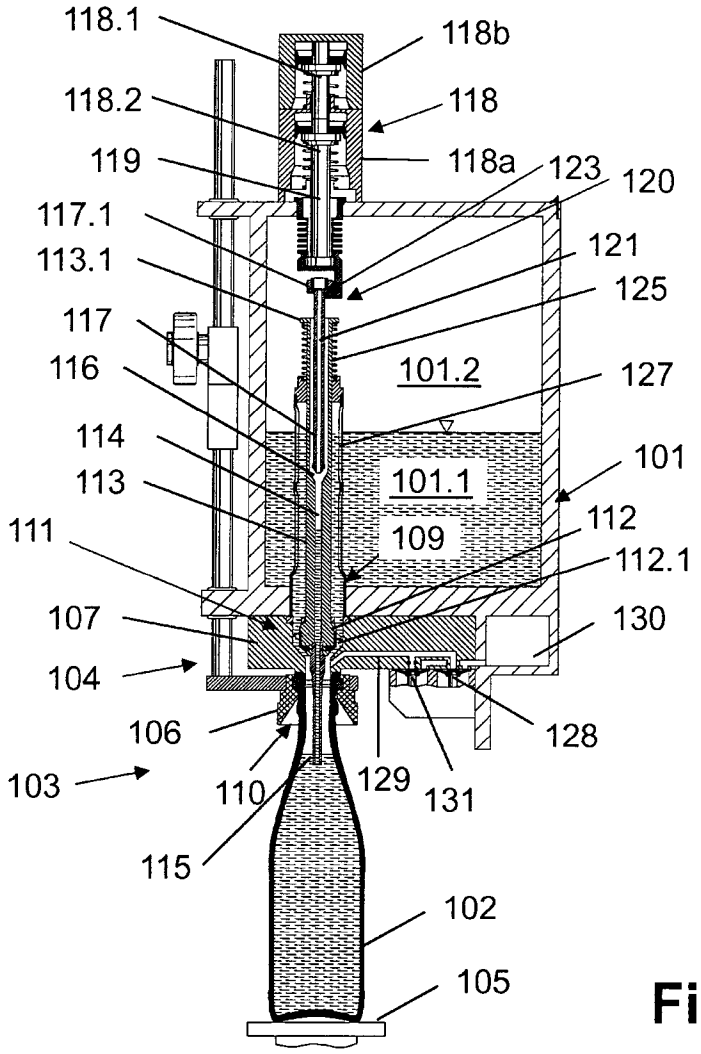
FIG. 12 shows a vertical section of the filling system of FIGS. 6 and 7 at the end of the filling process.
Figure 13:
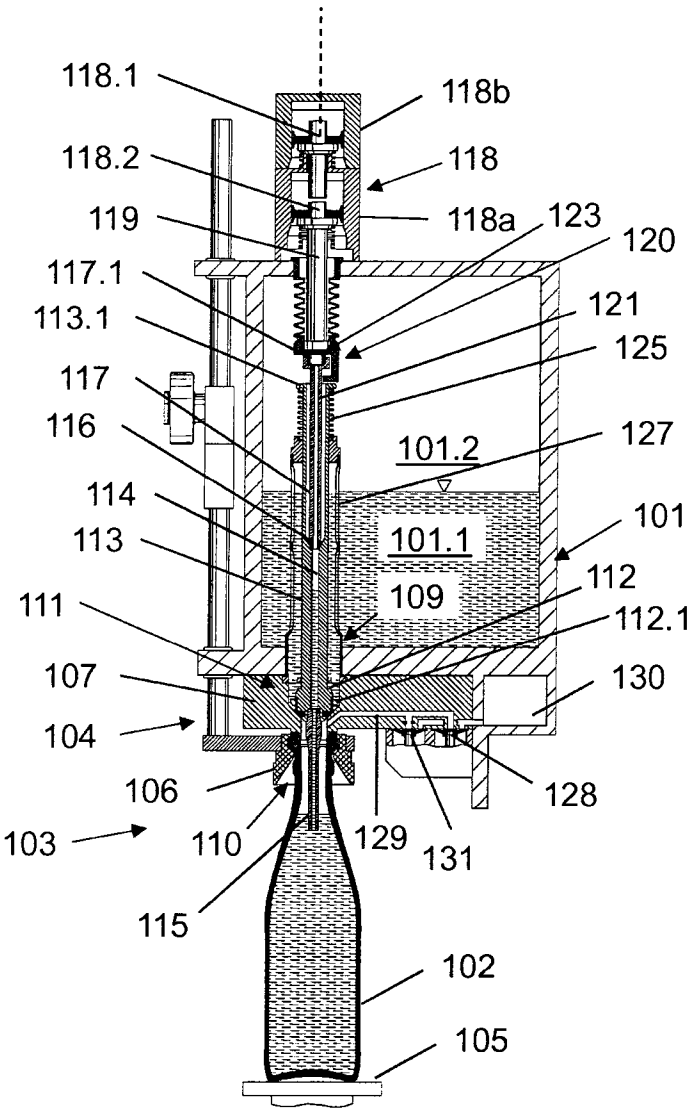
FIG. 13 shows a vertical section of the filling system of FIGS. 6 and 7 with the fluid valve closed.

To promote the fastest possible pretensioning of the next container 102 to the filling pressure, the piston rod of the upper piston-cylinder arrangement 118*b* moves into an upper position, as shown in FIG. 10. This enables the piston rod of the lower piston-cylinder arrangement 118*b* to carry out the maximum stroke path, which is equal to the sum of the first and second lift-extents H1+H2. This opens the first gas-valve 116, thus releasing a considerably greater volume flow out of the ring-vessel's gas-chamber 101.2 and into the container interior.

The spring's spring-force is chosen to be slightly greater than the sum of the weights of the liquid-valve body 112, the liquid-valve tappet-tube 113, and the column of the liquid filling-product contained in the ring vessel 101 that acts on the liquid-valve body 112, disregarding friction effects. As a result, when the pressure in the container interior and the pressure in the ring vessel 101 are at equilibrium, the spring 125 lifts the liquid-valve body 112 out of its valve seat in the filling element housing 107. This means that the liquid filling-product contained in the ring vessel 101 can flow via the liquid channel 108 and the filling-product discharge opening 110 into the container's interior. When this happens, the inert gas that was used to pretension the container 102 flows back via the gas tube 115, the first gas-channel 114, and the opened first gas-valve 116 into the ring-vessel gas-chamber 101.2 of the ring vessel 101.

As the level of liquid filling-product rises, it eventually immerses the gas tube 115. At this point, filling automatically ceases. In addition, the gas block 112.1 prevents gas from rising out of the container's head space and into the ring vessel 101.

By acting on the liquid-valve tappet-tube 113 via the adapter 120, the actuator 118 actively closes the liquid-valve 111. In particular, the hook's distal control surface 120.3 interacts with a proximal surface of the tappet-flange 113.1.

This interaction occurs as the piston rod of the lower piston-cylinder arrangement 118*a* returns into the lower initial position to reset the actuator tappet 119. As this happens, the hook's distal control surface 120.3 comes in contact against the proximal surface of the tappet-flange 113.1. This pushes the liquid-valve body 112 and compresses the spring 125 such that the liquid-valve body 112 is in fluid-tight contact against the filling element housing 107. In addition, the first and the second gas-valves 116, 123 close once again, thus separating the first and second gas channels 114, 121 from the ring-vessel gas-chamber 101.2.

Figure 14:
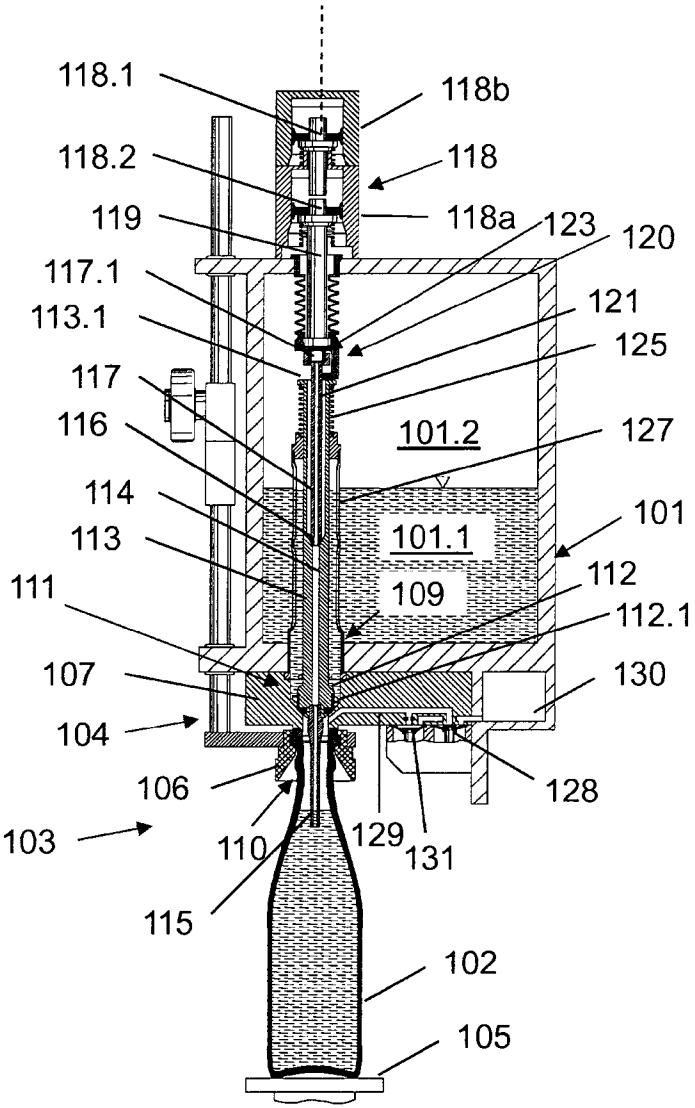
FIG. 14 shows a vertical section of the filling system of FIGS. 6 and 7 while relieving pressure in the container.

Referring now to FIG. 14, one the liquid-valve 111 and the first and second gas valves 116, 123 have been closed, a pressure-relief valve 131 establishes a connection between the container's interior and ambient air via the vacuum channel 129. This connection relieves the container's interior pressure to ambient pressure. This pressure relief procedure can be carried out gradually by causing a plurality of pressure-relief steps, and/or by using a choke in the vacuum channel 129. In either case, after the container's interior pressure reaches ambient pressure, it becomes possible to lower the container carrier 105, thus withdrawing the container 102 from its sealed position against the filling element 104.

Figure 15:
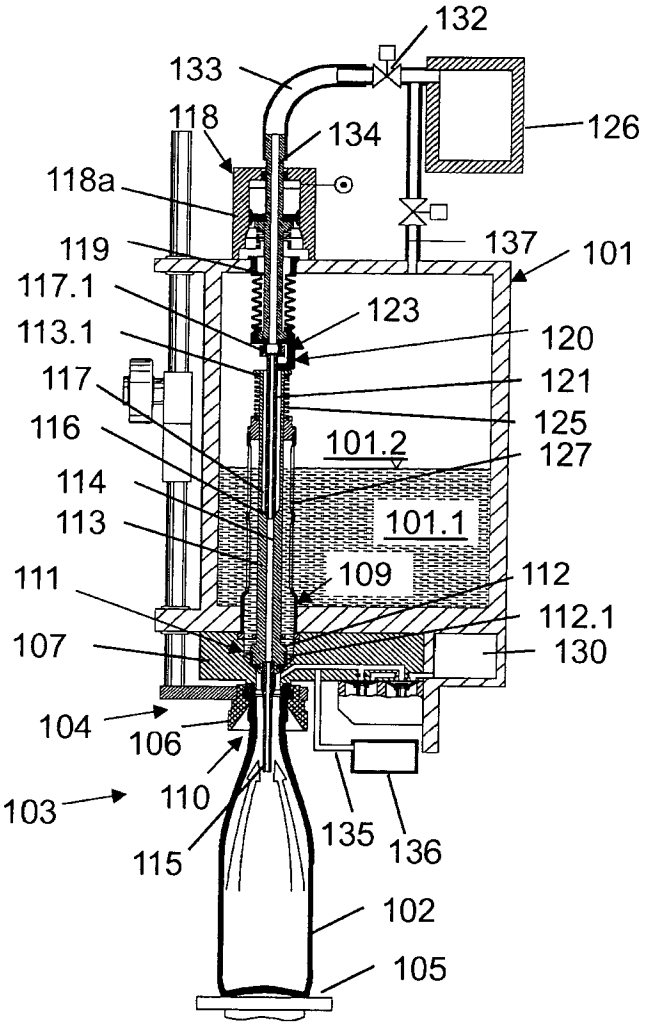
FIG. 15 shows an alternative embodiment of the filling element shown in FIGS. 6 and 7.

An alternative embodiment, shown in FIG. 15, includes a pretensioning-gas chamber 126 for containing a pretension gas that differs from the gas contained in the ring-vessel gas-chamber 101.2. A pretensioning control-valve 132 selectively connects the pretensioning-gas chamber 126 to a third gas-channel 134 via a flexible line 133. This third gas-channel extends through the piston rod of the actuator 18 along the filling-element axis FA.

The third gas-channel 134 connects at its lower end to the second gas-channel by way of the orifice 124 when the second gas-valve 123 closes and the adapter's sealing surface 120.2 engages the orifice 124. In this setting of the adapter 120, the first gas-valve 116 is closed. As a result, there exists a continuous gas channel from the pretensioning-gas chamber 126, via the flexible line 133, the third gas channel 134, the second gas-channel 121, the first gas-channel 114, and the gas tube 115 all the way into the container interior. An advantage of the embodiment shown in FIG. 15 is that the pretensioning-gas chamber 126 can supply a pretensioning gas that is more favorable than $CO_2$ for pretensioning the container 102.

In the embodiment shown in FIG. 15, the actuator 118 implements a single-step lift stroke. The extent of the lift stroke is chosen such that the actuator 118 causes only the second gas-valve 123 to open.

As a result, when the pretensioning control-valve 132 is closed and the actuator tappet 119 is raised to open the second gas-valve 123, a choked flow of gas from the ring-vessel gas-chamber 101.2 flushes the container's interior. However, when the first and second gas-valves 116, 123 close and the pretensioning control-valve 132 opens, pretensioning gas from the pretensioning-gas chamber 126 flows into the container's interior. This results in a more economical filling procedure.

Some embodiments use the Trion method for filling-level adjustment within the container so that the level of liquid filling-product is located beneath the lower edge of the gas tube 115. These embodiments include a Trinox channel 135 that connects a Trinox gas-chamber 136 to the container's headspace via the vacuum channel 129. Upon introduction of the Trinox gas, any liquid filling-product that overfills the container 104 returns to the ring vessel 101 via the gas tube 115, the first gas-channel 114, the second gas-channel 121, the third gas channel 134, and finally, the flexible line 133.

Figure 16:
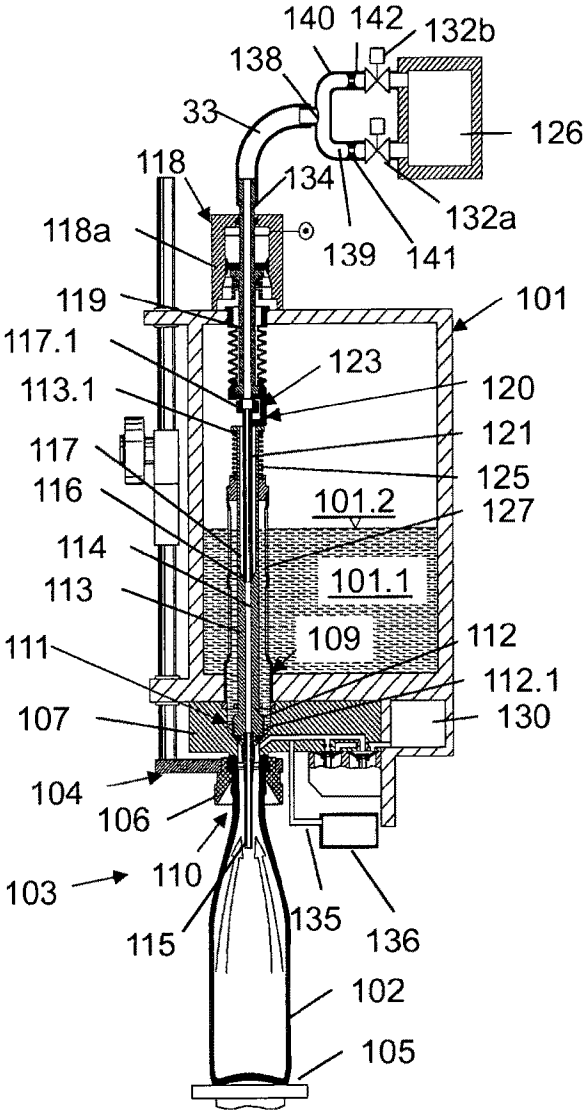
FIG. 16 shows another embodiment of the filling element shown in FIGS. 6 and 7.

Unlike the embodiment shown in FIG. 15, the embodiment shown in FIG. 16 has no choke to reduce gas flow through the needle-like gas-valve body 117 in the region of the second gas-channel 121. Instead, the choke is to the outside, and specifically in the region of the flexible line 133 that connects the third gas channel 134 to the pretensioning-gas chamber 126.

An additional distinction of the embodiment shown in FIG. 16 over that shown in FIG. 15 is the existence of a branch point 138 in the flexible line 133 between the third gas channel 134 and the pretensioning-gas chamber 126. This branch point 138 defines parallel first and second branches 139, 140 that both open into the pretensioning-gas chamber 126. Corresponding first and second branch control-valves 132*a*, 132*b* open and close independently of each other so as to permit individual control over the flow in the first and second branches 139, 140. This allows control over the rate at which gas can flow out of the pretensioning gas chamber 126.

Each of the parallel first and second branches 139, 140 also includes corresponding first and second branch-chokes 141, 142 for restricting volume flow through their respective branch channels 139, 140. Preferably, the first and second branch-chokes 141, 142 are of different dimensions so that different flow rates can be present in the corresponding first and second branches 139, 140. In one embodiment, the first branch-choke 141 has a smaller hole than the second branch-choke 142 so that the first branch-choke 141 permits a volume rate-of-flow that is lower than that permitted by the second branch-choke 142 for a given constant pressure inside the pretensioning gas chamber 126.

As a result, depending on the type of the flushing method, it is possible to select a particular flow rate through the third gas channel 134 and through the flexible line 133 by choosing which of the first and second branch control-valves 132*a*, 132*b* should be open. The ability to switch between different flow rates is particularly advantageous for filling machines that are intended to work with both plastic containers and glass containers. This is because for plastic containers, no vacuum support is provided, whereas for glass containers, vacuum support is provided. It has been assumed that container flushing takes place in a flushing phase of a filling process with the filling elements 1, 1*a* respectively. In principle, container flushing can also be carried out by other treatment heads that are not filling elements, for example by a treatment head of a machine that is upstream of a filling machine.

The invention has been described heretofore by way of embodiments. It is understood that numerous modifications and derivations are possible, without thereby departing from the inventive concept on which the invention is based.

Having described the invention, and a preferred embodiment thereof, what is claimed as new, and secured by Letters Patent is:

1. A method for processing containers using a container processing machine having a plurality of treatment heads, said method comprising, at a treatment head, flushing an interior of a container, wherein flushing an interior of said container at said treatment head comprises sealing said container against said treatment head, connecting said interior to a vacuum source, evacuating said interior, while said container is still connected to said vacuum source, introducing flushing gas into said interior, displacing gas out of said interior, and adjusting flow of said flushing gas and an underpressure of said vacuum source such that, while flushing gas flows through said interior, a flushing pressure in said interior lies between 0.46 and 0.9 bar.

2. The method of claim 1, wherein evacuating said interior comprises evacuating to a pressure between 0.05 bar and 0.4 bar, wherein introducing flushing gas begins only after completion of evacuation of said interior, wherein introducing flushing gas comprises causing pressure in said interior to rise as a result of introduction of said flushing gas up to a range between 0.46 and 0.9 bar.

3. The method of claim 1, wherein connecting said interior to a vacuum source comprises connecting said interior to a first gas channel that is formed in said treatment head, and wherein introducing flushing gas into said interior comprises introducing said flushing gas through a second gas channel formed in the treatment head.

4. The method of claim 1, wherein introducing flushing gas into said interior comprises causing said flushing gas to emerge at a point along a central axis of said container.

5. The method of claim 1, wherein introducing flushing gas into said interior comprises extending a tube into said interior and causing said flushing gas to flow into said interior through said tube.

6. The method of claim 1, further comprising causing said flushing gas to flow from a gas chamber that contains said flushing gas under pressure, and, using a choke, choking flow of said flushing gas.

7. The method of claim 1, further comprising, using a pressure sensor, providing information indicative of said flushing pressure, and controlling said flushing pressure based at least in part on said information.

8. The method of claim 7, wherein said pressure sensor monitors pressure only for said treatment head.

9. The method of claim 7, wherein said pressure sensor monitors pressures at each treatment position in said plurality of treatment positions.

10. The method of claim 1, further comprising, after flushing said interior, filling said interior with liquid filling-product.

11. The method of claim 10, wherein filling said interior with liquid filling-product comprises obtaining said liquid filling-product from a filling-product container having a gas space at a first pressure, said method further comprising providing said flushing gas from a flushing-gas source having flushing gas at a second pressure, wherein said second pressure is independent of said first pressure.

12. The method of claim 1, further comprising causing pretensioning-gas to flow into said interior at a pretensioning-gas flow rate, wherein introducing flushing gas into said interior comprises causing said flushing gas to flow at a flushing-gas flow-rate, and wherein said flushing-gas flow-rate is less than said pretensioning-gas flow-rate.

13. The method of claim 1, further comprising operating a first gas valve to permit pretensioning-gas to flow into said interior, wherein introducing flushing gas into said interior comprises operating a second gas valve to permit said flushing gas to flow into said interior, and wherein said first and second gas valves are different gas valves.

14. An apparatus for processing containers, said apparatus comprising a treatment head, said treatment head comprising means for flushing an interior of a container, said means for flushing comprising means for sealing said container against a treatment head, means for connecting said interior to a vacuum source, means for evacuating said interior, means for introducing flushing gas into said interior while said container is still connected to said vacuum source, and means for adjusting flow of said flushing gas and an under-pressure of said vacuum source such that, while flushing gas flows through said interior, a flushing pressure in said interior lies between 0.46 and 0.9 bar.

* * * * *